US007102092B2

(12) United States Patent
Hishikawa

(10) Patent No.: US 7,102,092 B2
(45) Date of Patent: Sep. 5, 2006

(54) POWER WINDOW SWITCH APPARATUS

(75) Inventor: Koji Hishikawa, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/995,375

(22) Filed: Nov. 24, 2004

(65) Prior Publication Data

US 2005/0109600 A1 May 26, 2005

(30) Foreign Application Priority Data

Nov. 26, 2003 (JP) ..... P2003-395562

(51) Int. Cl.
*H01H 3/00* (2006.01)

(52) U.S. Cl. ..... 200/339; 200/315

(58) Field of Classification Search ..... 200/339, 200/315, 553, 561, 433–438, 526
See application file for complete search history.

(56) References Cited

U.S. PATENT DOCUMENTS

| | | | | |
|---|---|---|---|---|
| 5,285,039 | A * | 2/1994 | Satoh | 200/563 |
| 5,329,163 | A * | 7/1994 | Satoh et al. | 307/10.1 |
| 5,555,973 | A * | 9/1996 | Horisawa | 200/561 |
| 5,845,767 | A * | 12/1998 | Suzuki | 200/524 |
| 6,005,201 | A * | 12/1999 | Tanaka et al. | 200/16 C |
| 6,566,619 | B1 * | 5/2003 | Gillman et al. | 200/339 |
| 6,596,956 | B1 * | 7/2003 | Czarnecki | 200/552 |
| 6,794,592 | B1 * | 9/2004 | Liu et al. | 200/302.3 |
| 6,841,750 | B1 * | 1/2005 | Sasaki | 200/553 |
| 6,857,357 | B1 * | 2/2005 | Fujii | 100/339 |
| 6,884,954 | B1 * | 4/2005 | Onodera | 200/339 |
| 6,903,293 | B1 * | 6/2005 | Sasaki | 200/339 |
| 2001/0004044 | A1 * | 6/2001 | Sotome et al. | 200/5 R |
| 2002/0189925 | A1 * | 12/2002 | Onodera | 200/315 |
| 2003/0029706 | A1 * | 2/2003 | Gillman et al. | 200/339 |
| 2003/0042124 | A1 * | 3/2003 | Seki et al. | 200/553 |
| 2003/0159912 | A1 * | 8/2003 | Sasaki | 200/553 |
| 2004/0163940 | A1 * | 8/2004 | Ravnkilde et al. | 200/339 |
| 2005/0045454 | A1 * | 3/2005 | Zhou | 200/16 R |
| 2005/0051413 | A1 * | 3/2005 | Altmann | 200/339 |
| 2005/0092594 | A1 * | 5/2005 | Parro et al. | 203/100 |

FOREIGN PATENT DOCUMENTS

| | | |
|---|---|---|
| DE | 71 38 974 U1 | 7/1979 |
| DE | 198 12 249 C1 | 9/1999 |
| EP | 0 773-568 A2 | 5/1997 |
| JP | H05-65028 | 8/1993 |
| JP | 2000-348570 A | 12/2000 |

* cited by examiner

*Primary Examiner*—Michael Friedhofer
*Assistant Examiner*—Lisa Klaus
(74) *Attorney, Agent, or Firm*—Morgan, Lewis & Bockius LLP

(57) ABSTRACT

A power window switch apparatus includes: a switch body; a operating knob pivotally supported by the switch body; a first stopper that is provided to the switch body and restricts a rotation of the operating knob to a first predetermined angle; and a second stopper that is provided to the switch body and restricts the rotation of the operating knob to a second predetermined angle when the first stopper becomes impossible to restrict the rotating of the operating knob.

5 Claims, 5 Drawing Sheets

POWER WINDOW SWITCH APPARATUS

BACKGROUND OF THE INVENTION

The present invention relates to a power window switch apparatus in which a rotating angle restricting structure of an operating knob is improved.

Generally, in a power window switch apparatus of a vehicle, especially automobile, as shown in FIGS. 4 and 5, operating knobs 2 are pivotally supported by a switch body 1 through shafts 3 (pivot). The operating knobs 2 includes at opposite side surfaces thereof the shafts 3 or holes 4 to be engaged with the shafts 3, and further includes an projection 5 and an operation rod 6 which are projected downwardly from an inner upper portion thereof. A fork-shaped engaging portion 7 is formed at a distal end of the operating rod 6 relatively extended from the projection 5. The operating knob 2 includes an operating portion 20 through which an operator can operates the operating knob 2.

On the other hand, a switch module 8 is provided inside the switch body 1. Although the detail is not shown in the drawings, the switch 8 module includes at an inside thereof a contact holder for holding a movable contact and a fixed contact for selectively contact with the movable contact according to movement of the contact holder for opening and closing a window of the vehicle by electric power. A pin 9 for moving the contact holder is projected outwardly from a groove 10 at a side portion of the switch module 8, and is engaged with the engaging portion of the operating rod 6.

A stopper 11 is formed at the switch body 1. The stopper 11 is associated with the projection 5 of the operating knob 2 and restricts a rotating angle of the operating knob 2 to a predetermined angle $\alpha$ by an abutment against the projection 5 when the operating knob 2 is rotated in an upper direction shown by an arrow A of FIG. 6. Accordingly, the projection 5 functions as an abutment portion against which the stopper is abutted.

When the operating knob 2 is operated to rotate in the upper direction shown by the arrow A of FIG. 6, the operating rod 6 causes the pin 9 to move forward shown by an arrow B by the engaging portion 7 until the projection 5 is abutted against the stopper 11, thereby the switch module 8 shifts to a state for opening the window (for example, a window at the driver seat side) of the automobile associated with the operated operating knob 2. That is, the switch module 8 functions as a reaction apparatus that is operated in response to the rotation of the operating knob 2.

Incidentally, in a state that the projection 5 is abutted against the stopper 11, a clearance is provided between an end portion of the groove 10 and the pin 9 of the switch module 8. When the operation of the operating knob 2 is released from this state, returning means such as spring provided to the operating knob 2, for example, returns the operating knob 2 to an initial position (neutral position), and as the result the switch module 8 also returns to the initial position (neutral position).

On the other hand, when the operating knob 2 is operated to rotate downwardly as shown by an arrow C of FIG. 7, the operating rod 6 moves the pin 9 rearwardly as shown by an arrow d by the engaging portion 7, and as a result the switch module 8 shifts to a state for closing the window of the automobile associated with the operated operating knob 2. Incidentally, the operation of the operating knob 2 is released from this state, the operating knob 2 returns to the initial position (neutral position) by the returning means and as a result the switch module 8 also returns to the initial position (neutral position).

Patent literature: Japanese Utility Model Publication H05-65028.

In the above apparatus, the projection 5 is abutted against the stopper 11 every time the operating knob 2 is rotated upwardly. Therefore, there is a fear that the stopper 11 be damaged due to fatigue by a long-term use. FIG. 8 shows such a state. Due to the damage of the stopper 11, the operated knob 2 is rotated exceeding the original restricting angle $\alpha$. In this state, since an operator tends to depress the operating knobs 9 until the pin 9 of the switch module 8 is abutted against the distal end of the groove 10, these is a fear that a damage S occurs at a portion of the engaging portion 7 of the operating rod 6 (especially, a portion 6*a* at a rear side of the engaging portion 7).

In the case that the damage S occurs at the portion 6*a* of the operating rod 6, even after the operating knob 2 is rotated downwardly and the operation is released, the operating knob 2 is returned but the switching module 8 is not returned and it may cause an abnormal state that energization of a drive motor continues while the window of the automobile associated with the operated operating knob 2 is kept in a close state.

SUMMARY OF THE INVENTION

In view of the above problem, an object of the present invention is to provide a power window switch that prevent the abnormal state from occurring even if the damage occurs at the stopper which restricts the rotation of the operating knob to the predetermined angle.

In order to solve the aforesaid object, the invention is characterized by having the following arrangement.

(1) A power window switch apparatus comprising:

a switch body;

a operating knob pivotally supported by the switch body;

a first stopper that is provided to the switch body and restricts a rotation of the operating knob to a first predetermined angle; and a second stopper that is provided to the switch body and restricts the rotation of the operating knob to a second predetermined angle when the first stopper becomes impossible to restrict the rotating of the operating knob.

(2) The power window switch apparatus according to (1), wherein the second predetermined angle is larger than the first predetermined angle.

(3) The power window switch apparatus according to (1), wherein the operating knob includes an operating rod that includes an operating portion through which an operator can operates the operating knob, a distal end for operating a switch module, and a pivot about which the operating knob is rotatable.

(4) The power window switch apparatus according to (3), wherein the first stopper is adapted to be abutted against a portion of the operating rod between the operating portion and the pivot, and the second stopper is adapted to be abutted against a portion of the operating rod between the pivot and the distal end.

According to the present invention, since the second stopper restrict the rotation of the operating knob to the predetermined angle even if the first stopper is damaged, the abnormal state can be prevented any more.

DETAILED DESCRIPTION OF PREFERRED EMBODIMENTS

Figure 2:
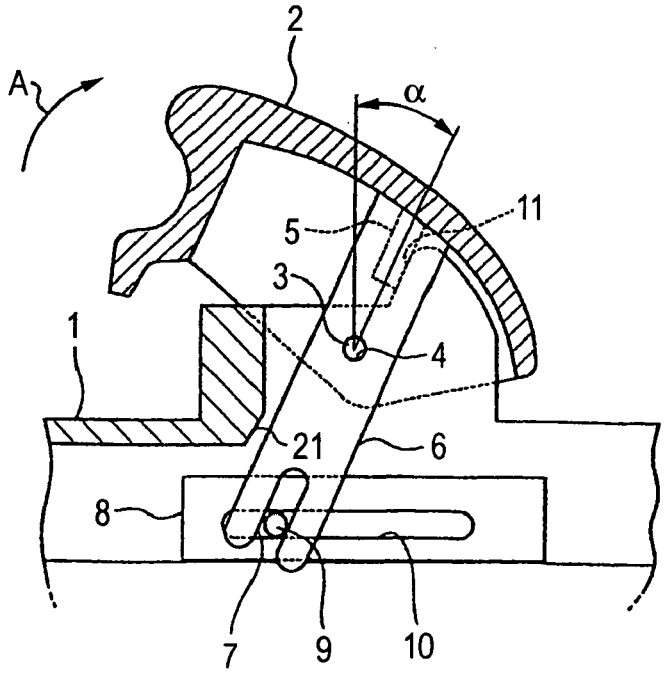
FIG. 2 is a vertical cross section diagram showing a first operating state of the primary portion.
Figure 3:
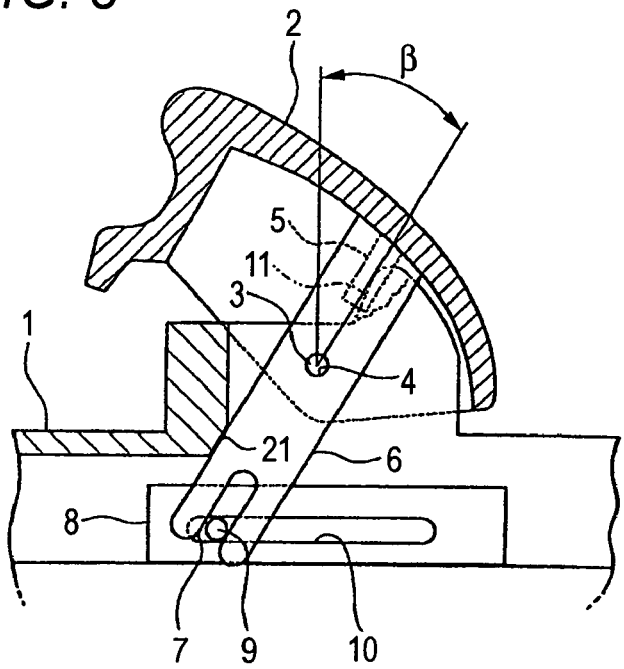
FIG. 3 is a vertical cross section diagram showing a second operating state of the primary portion.
Figure 4:
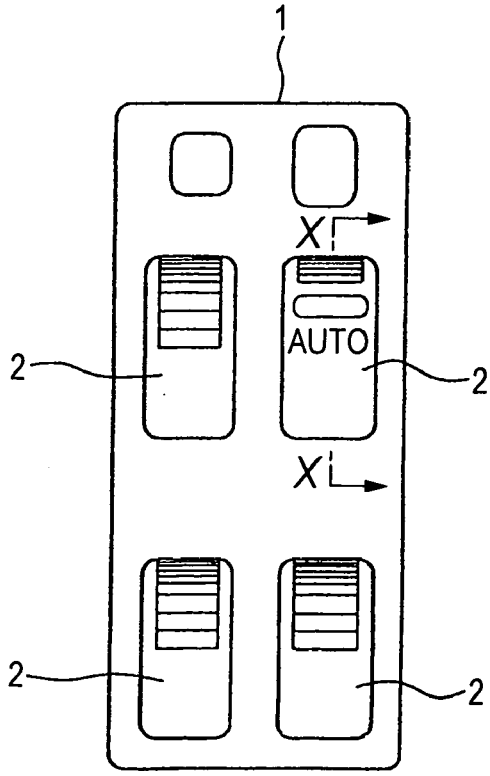
FIG. 4 is a plan view of a whole apparatus of the related art.
Figure 5:
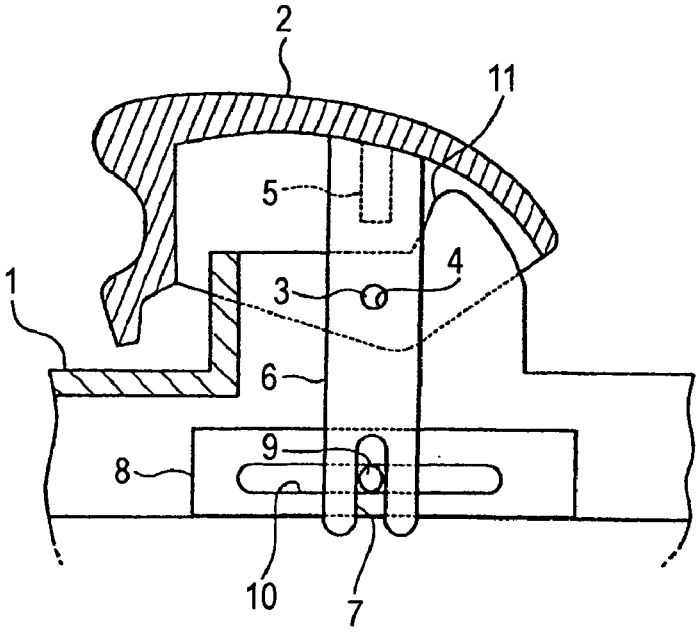
FIG. 5 is a vertical cross section diagram of a primary portion view along X—X line of FIG. 4. (Corresponding to FIG. 1)
Figure 6:
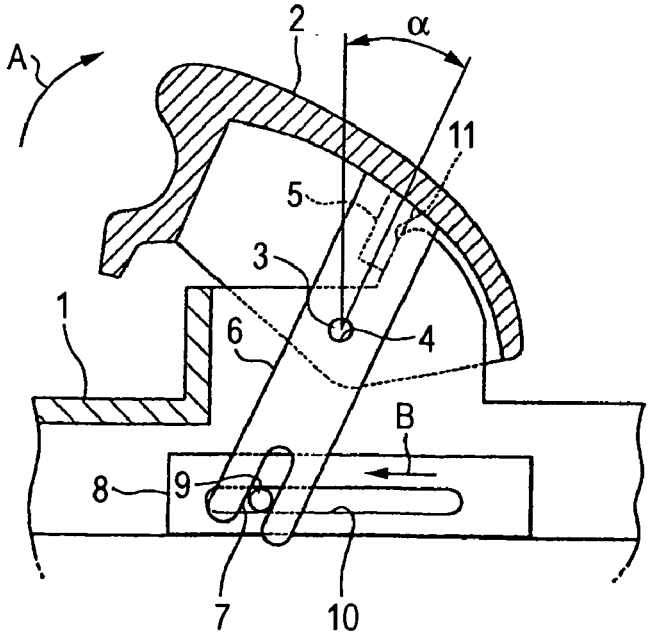
FIG. 6 is a vertical cross section diagram showing a first operating state of the primary portion. (Corresponding to FIG. 2)
Figure 7:
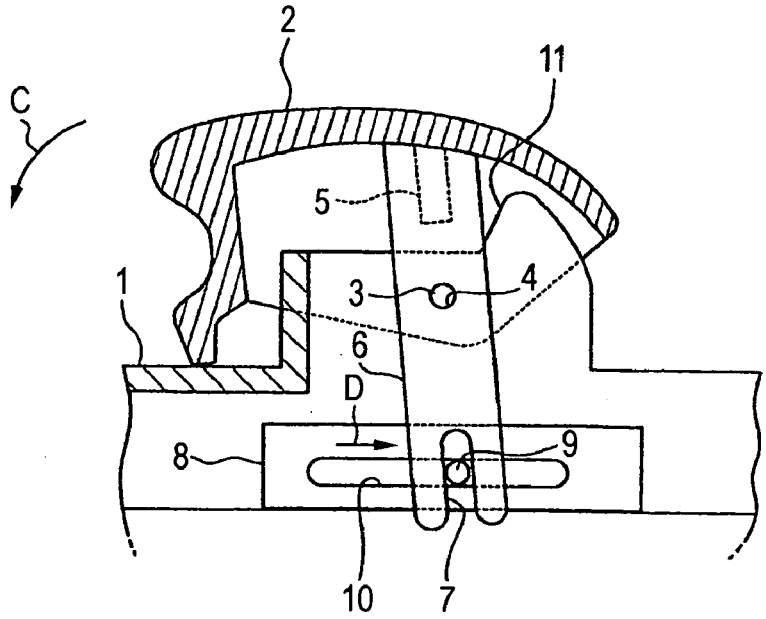
FIG. 7 is a vertical cross section diagram showing a second operating state of the primary portion.
Figure 8:
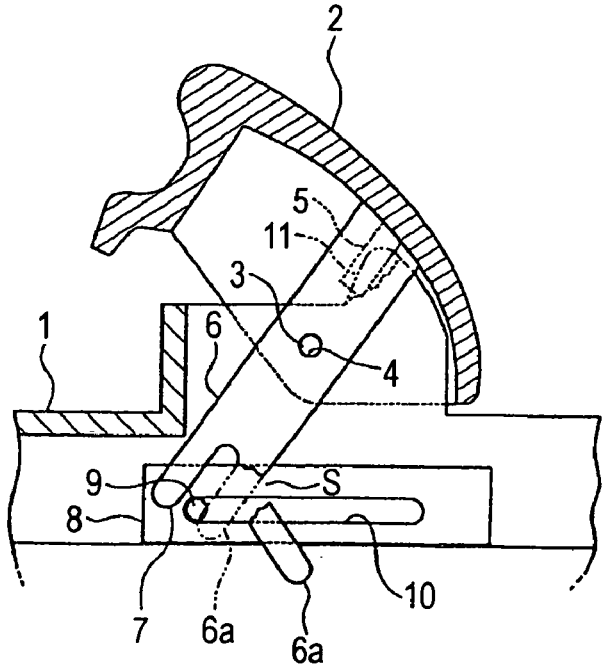
FIG. 8 is a vertical cross section diagram showing a third operating state of the primary portion. (Corresponding to FIG. 3)
Figure 9:
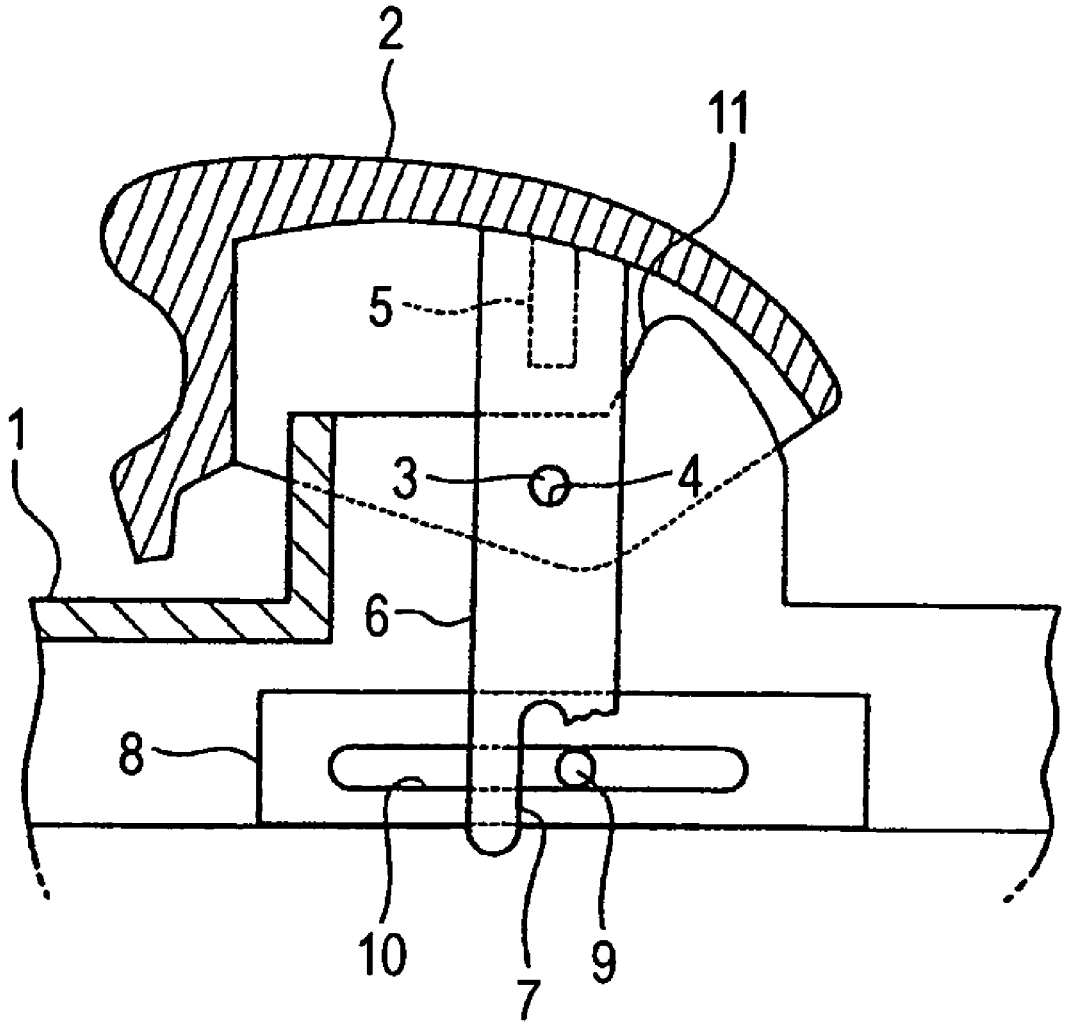
FIG. 9 is a vertical cross section diagram showing a fourth operating state of the primary portion.

An embodiment according to the present invention will be described hereinafter with reference to FIGS. 1 to 3.

Figure 1:
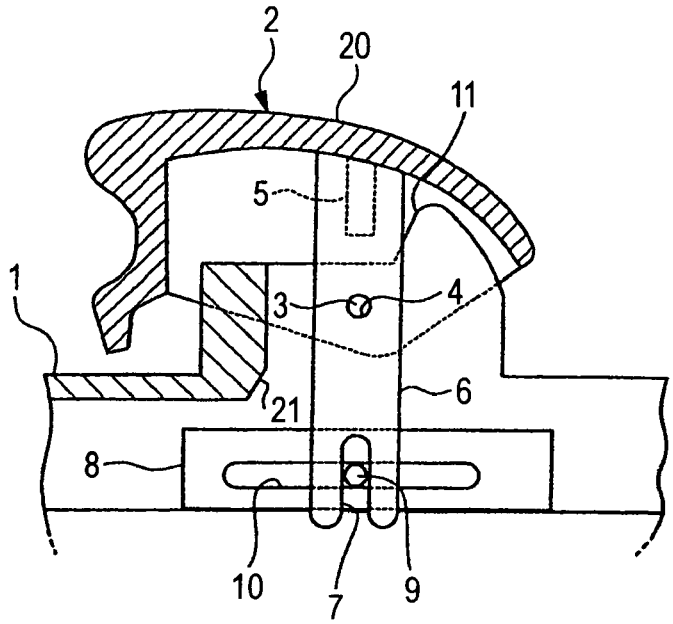
FIG. 1 is a vertical cross section diagram of a primary portion showing an embodiment according to the present invention.

Component parts shown in FIG. 1 substantially similar to those in the related art shown in FIGS. 4 to 9 are given same reference number and the description thereof will be omitted. The embodiment according to the invention differs from the related art in that a second stopper 21 is provided to the switch body 1 in addition to the stopper 11. For ease of the explanation, the stopper 11 is called as a first stopper hereinafter. The second stopper 21 and the first stopper 11 are substantially symmetrical with a point of the shaft 3 (hole 4). A portion close to the distal end of the operating rod 6 corresponds to the second stopper 21. A predetermined rotating angle β described later of the operating knob 2 when the portion close to the distal end of the operating rod 6 is abutted against the second stopper 21 is set larger than the predetermined rotating angle α of the operating knob 2 when the projection 5 is abutted against the first stopper 11.

With the above described structure, the operation of rotating the operating knob 2 upwardly and the operation of each parts according to this operation as well as the operation of rotating the operating knob 2 downwardly and the operation of each parts according to this operation are the same as described above. Especially, when the operating knob 2 is operated to rotate upwardly, the rotation of the operating knob 2 is restricted to the predetermined angle α by abutting the projection 5 against the first stopper 11 as shown in FIG. 2 and this is same as described above.

When the apparatus is used for long term and the damage occurs due to fatigue of the stopper 11, the operating knob 2 is rotated exceeding the predetermined original restricting angle α. However, thereafter, the portion closed to the distal end of the operating rod 6 which has not been abutted against the second stopper 21 before is abutted against the second stopper as shown in FIG. 3, and as a result the rotation of the operating knob 2 is restricted to the predetermined angle β that is not so different from the restricting angle α by the first stopper 11.

Thus, the abnormal state can be prevented from occurring that is, the damage S can be prevented from occurring at the portion of the engaging portion 7 of the operating rod 6, which may occurs in the related art, and the undesirable continuous energization of the drive motor can be prevented while the switch module 8 is not returned and the window of the automobile is kept in closed state. Therefore, the present invention can keep the power window switch apparatus working normally.

Of course, the present invention is not limited to the embodiment described above and shown in the drawings, and can be realized by any modification without departing from the scope of the invention.

What is claimed is:

1. A power window switch apparatus comprising:

a switch body;

an operating knob pivotally supported by the switch body, wherein the opening knob includes an operating rod;

a first stopper that is provided to the switch body and restricts a rotation of the operating knob to a first predetermined angle by abutting against the operating rod; and a second stopper that is provided to the switch body and restricts the rotation of the operating knob to a second predetermined angle by abutting against the operating rod when the first stopper becomes impossible to restrict the rotating of the operating knob.

2. The power window switch apparatus according to claim 1, wherein the second predetermined angle is larger than the first predetermined angle.

3. The power window switch apparatus according to claim 1, wherein the operating rod includes an operating portion through which an operator can operate the operating knob, a distal end for operating a switch module, and a pivot about which the operating knob is rotatable.

4. The power window switch apparatus according to claim 1, wherein the first stopper is adapted to be abutted against a portion of the operating rod between the operating portion and the pivot, and the second stopper is adapted to be abutted against a portion of the operating rod between the pivot and the distal end.

5. A power window switch apparatus comprising:

a switch body;

an operating knob pivotally supported by the switch body, wherein the operating knob includes an operating rod;

a first stopper that is provided to the switch body and restricts a rotation of the operating knob to a first predetermined angle by abutting against a projection along the operating rod; and a second stopper that is provided to the switch body and restricts the rotation of the operating knob to a second predetermined angle by abutting against a portion of the operating rod when the first stopper becomes impossible to restrict the rotating of the operating knob.

* * * * *